United States Patent [19]

Arai

[11] Patent Number: 5,043,259

[45] Date of Patent: Aug. 27, 1991

[54] PRE-FOGGED DIRECT POSITIVE SILVER HALIDE EMULSIONS

[75] Inventor: Naoki Arai, Kanagawa, Japan

[73] Assignee: Fuji Photo Film Co., Ltd., Kanagawa, Japan

[21] Appl. No.: 527,968

[22] Filed: May 24, 1990

[30] Foreign Application Priority Data

May 24, 1989 [JP] Japan ..... 1-130982

[51] Int. Cl.[5] ..... G03C 1/485

[52] U.S. Cl. ..... 430/596; 430/597; 430/569; 430/607; 430/940

[58] Field of Search ..... 430/597, 596, 611, 607, 430/569, 940, 608

[56] References Cited

U.S. PATENT DOCUMENTS 3,466,173 9/1969 Ishikawa et al. ..... 430/596

3,885,970 5/1975 Miyahara ..... 430/607

*Primary Examiner*—Charles L. Bowers, Jr.

*Assistant Examiner*—Janis L. Dote

*Attorney, Agent, or Firm*—Sughrue, Mion, Zinn, Macpeak & Seas

[57] ABSTRACT

A pre-fogged direct positive silver halide emulsion comprising silver halide grains which have been formed in the presence of a compound represented by the following formula (I):

$$R—SO_2—M \quad (I)$$

wherein R represents an aliphatic group, an aromatic group or a heterocyclic group, and M represents a hydrogen atom or a cation. The invention also relates to a method for making such a photographic material.

18 Claims, No Drawings

PRE-FOGGED DIRECT POSITIVE SILVER HALIDE EMULSIONS

FIELD OF THE INVENTION

This invention relates to a pre-fogged direct positive silver halide emulsions having increased photographic speed and a method for preparing such an emulsion.

BACKGROUND OF THE INVENTION

The processing time of dupe sensitive materials for medical purposes is generally long, such process requiring from 20 seconds to 30 seconds. It is desirable that this period should be shortened to a period of 0.5 to a few seconds. There are methods in which such a reduction is achieved by increasing the exposure in the duplicator, but increasing the photographic speed of the sensitive material is preferred since it does not necessitate modification of the duplicator.

SUMMARY OF THE INVENTION

One object of the present invention is to provide a pre-fogged direct positive silver halide emulsion having a high speed.

Another object of the present invention is to provide method for the preparation of high speed pre-fogged direct positive silver halide emulsions.

This and other objects of the invention have been realized by a pre-fogged direct positive silver halide emulsion comprising silver halide grains which have been formed in the presence of a compound represented by formula (I).

$$R—SO_2—M \quad (I)$$

wherein R represents an aliphatic group, an aromatic group or a heterocyclic group, and M represents a hydrogen atom, or a cation.

DETAILED DESCRIPTION OF THE INVENTION

The aliphatic groups represented by R in formula (I) are straight-chain, branched or cyclic alkyl groups, alkenyl groups or alkynyl groups which preferably have from 1 to 30 carbon atoms, more preferably from 1 to 18 carbon atoms. The branched alkyl groups may be cyclized to form a saturated heterocyclic ring which contains one or more hetero atoms. Examples of such aliphatic groups include methyl, t-butyl, n-octyl, t-octyl, cyclohexyl, hexenyl, n-dodecyl and tetrahydrofuryl.

The aromatic groups represented by R are monocyclic ring, bicyclic ring or tricyclic ring aryl groups (e.g., phenyl, naphthyl, anthryl), and they preferably have from 6 to 18 carbon atoms.

The heterocyclic groups represented by R are from three- to ten-membered saturated or unsaturated heterocyclic groups which contain at least one atom selected from among the N, O and S atoms. They may be monocyclic rings, or they may form condensed rings with aromatic or other heterocyclic rings.

Five- or six-membered aromatic heterocyclic groups, for example, thienyl, pyridyl, imidazolyl, triazolyl, tetrazolyl, quinolinyl, isoquinolinyl, pyrimidyl, pyrazolyl, benzimidazolyl, benztriazolyl, oxazolyl, benzoxazolyl, thiazolyl and benzthiazolyl groups, are preferred R may be substituted with substituent groups. Examples of these substituent groups include an alkyl group, an alkenyl group, an alkynyl group, an aryl group, an alkoxy group, an aryloxy group, an amino group, an acylamino group, a sulfonylamino group, a carbamoyl group, a sulfamoyl group, a sulfonyl group, a sulfinyl group, a ureido group, a urethane group, an alkylthio group, an arylthio group, a hydroxyl group, a halogen atom, a cyano group, a sulfo group, a carboxyl group, an acyl group, an alkoxycarbonyl group, an aryloxycarbonyl group, an acyloxy group, a carboxamido group, a sulfonamido group, a nitro group, an alkylthio group and an arylthio group.

Akali metal ions, alkaline earth metal ions, ammonium ions, phosphonium ions and guanidium ions, for example, are preferred as the cations represented by M.

Specific examples of compounds which can be represented by formula (I) are indicated below, but the invention is not limited to these compounds:

$CH_3SO_2Na$ (I-1)

$C_2H_5SO_2K$ (I-2)

$^nC_4H_9SO_2Na$ (I-3)

$^iC_4H_9SO_2Na$ (I-4)

$^tC_4H_9SO_2Na$ (I-5)

$(^nC_{16}H_{33}SO_2)_2Mg$ (I-6)

$NaO_2S—(CH_2)_2—SO_2Na$ (I-7)

$NaO_2S—(CH_2)_4—SO_2Na$ (I-8)

(I-9)

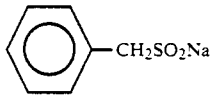

$HOCH_2SO_2Na$ (I-10)

(I-11)

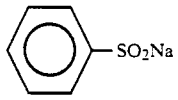

(I-12)

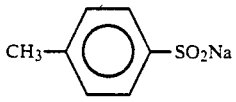

(I-13)

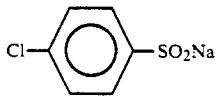

(I-14)

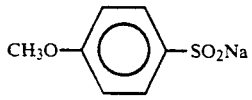

(I-15)

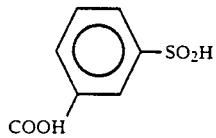

-continued (I-16)

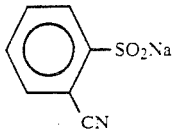

(I-17)

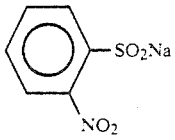

(I-18)

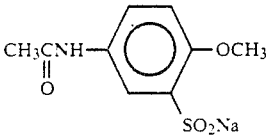

(I-19)

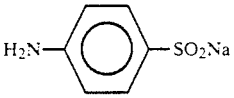

(I-20)

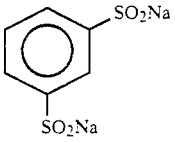

(I-21)

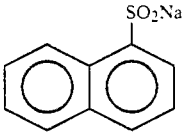

(I-22)

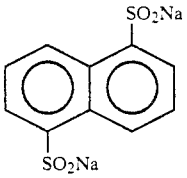

(I-23)

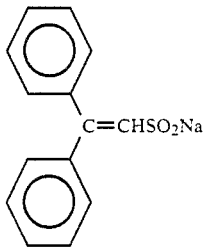

(I-24)

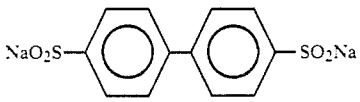

(I-25)

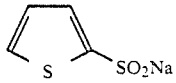

-continued (I-26)

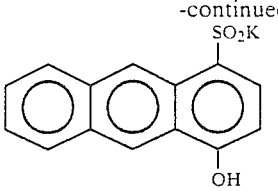

(I-27)

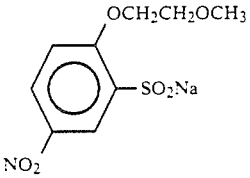

(I-28)

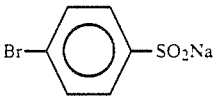

The compounds represented by formula (I) used in the present invention can be prepared, for example, with reference to Chemical Reviews, Vol. 49, pages 69–124 (1951).

The amount of the compound of formula (I) of the present invention added to the silver halide grains is from 0.1 to 23 grams, and preferably from 0.2 to 20 grams, per mol of silver.

The silver halide emulsions used in the present invention may be a monodisperse or a polydisperse emulsion, but a monodisperse emulsion is preferred. Furthermore, mixtures of two or more types of a monodisperse emulsion of a different grain size, as disclosed in the specification of JP-A-63-83719, can also be used. (The term "JP-A" as used herein signifies an "unexamined published Japanese patent application".)

A (100) plane and a (111) plane are both good, and the (100) plane/(111) plane ratio preferably has a value of at least 1.

Monodisperse silver halide emulsions of which the (100) plane/(111) plane ratio has a value of at least 1 which can be used in the present invention can be prepared using various methods.

The most common method is one in which an aqueous solution of silver nitrate and an aqueous solution of alkali metal halide are added simultaneously at a rate higher than the grain dissolution rate but such that not much reformation of nuclei occurs, while maintaining the pAg value during grain formation at a constant value of not more than 8.10 (the so-called controlled double jet method). The pAg value is preferably maintained at 7.80 or less, and most desirably it does not exceed 7.60. The formation of silver halide grains can be divided into two processes, namely nuclei formation and growth. The pAg value during the growth process in particular should not be more than 8.10, preferably not more than 7.80, and most desirably not more than 7.60. The system in which the soluble silver salt and the soluble halogen salts are reacted may be a single-jet method, but double-jet method is better for obtaining good monodispersity. The compounds represented by formula (I) are present preferably from the beginning of grain formation.

The silver halide emulsions used in the present invention contain at least 50 wt%, preferably at least 60 wt%, and most desirably at least 80 wt%, silver halide grains having the (100) plane/(111) plane ratio of at least 1, preferably at least 2, and most desirably at least 4.

The photosensitive silver halide used in the present invention may be any silver halide which comprises silver chloride, silver bromide and/or silver iodide, for example, silver bromide, silver iodobromide, silver chloride, silver chlorobromide, silver chloroiodide and silver chloroiodobromide, but silver bromide, silver iodobromide and silver chloroiodobromide are preferred. The silver iodide content of the silver halide is preferably from 0 to 4 mol%, and most desirably from 0 to 2 mol%. The silver chloride content of the silver halide is preferably not more than 40 mol% at the most, and it is more desirably not more than 20 mol% and most desirably not more than 10 mol%.

These emulsions may have coarse grains or fine grains, or they may have a mixture of such grains. But they preferably comprise emulsion grains having an average grain size (as measured, for example, using the projected area method or the numerical average method) of from about 0.21 $\mu$ to about 0.50 $\mu$. The grain form is preferably cubic but, provided that the plane index conditions described above are satisfied, the grains may have an irregular crystalline form, such as a potato-like form, a spherical form, a plate-like form or a tabular form in which the grain diameter is at least 5 times the grain thickness (the details of which are disclosed in Research Disclosure, Item No. 22534, p.20 – p.58 (January 1983)). Essentially non-photosensitive emulsions (for example, internally fogged fine grain emulsions) may be mixed with these photosensitive emulsions. Additionally they may be coated in separate layers.

Moreover, the crystal structure of the silver halide grains may be uniform. Or the interior and exterior parts may have a stratified structure, or it may be of the so-called conversion type such as that disclosed in British Patent 635,841 or U.S. Pat. Nos. 3,622,318.

Preferably, iridium ions are added to the silver halide grains. This can be achieved by adding water soluble iridium salts (for example, hexachloroiridium(III) acid salts or hexachloroiridium(IV) acid salts) in the form of aqueous solutions during the preparation of the silver halide emulsion. These solutions may be included in the aqueous solution containing the halide which is used for grain formation. Or they may be added prior to grain formation, during grain formation, or during the period after grain formation and prior to fogging. However, these solutions are preferably added during grain formation. The iridium ions are most desirably embedded in the grains.

It is preferred to use from $10^7$ to $10^{-3}$ mol of iridium ion per mol of silver halide to increase the speed of the emulsion in the present invention, but the use of from $5\times10^{-7}$ to $5\times10^{-4}$ mol of iridium ion per mol of silver halide is most preferred.

Silver halide solvents, for example, ammonia, potassium thiocyanate, ammonium thiocyanate, thioether compounds (for example, those disclosed in U.S. Pat. Nos. 3,271,157, 3,574,628, 3,704,130, 4,297,439 and 4,276,347), thione compounds (for example, those disclosed in JP-A-53144319, JP-A-53-82408 and JP-A-55-77737) and amine compounds (for example, those disclosed in JP-A-54-100717) can be used during the formation of the silver halide grains in order to control grain growth. Compounds which are adsorbed on the grain surfaces and control the crystal habit, for example aniline dyes, tetrazaindene compounds and mercapto compounds, can be used in addition to the silver halide solvents during grain formation.

The (100) plane/(111) plane ratio of the grains can be determined using the Kubelka-Monk dye adsorption method (referred to hereinafter as the Kubelka-Monk method). With this method, a dye which is adsorbed preferentially on either the (100) plane or the (111) plane and for which the spectrum differs in the state in which it is associated with the (100) plane differs from that in which it is associated with the (111) plane is selected. Such a dye is added to the emulsion and the (100) plane/(111) plane ratio can be determined by observing the relationship between the amount of dye added and the spectrum.

The fogging of the direct positive type silver halides used in the present invention can be carried out using well known techniques after the removal of the water soluble salts which have been formed after the precipitation and formation of the above mentioned silver halide. Fogging can be carried out using a fogging agent alone, or by a combination of a fogging agent and a gold compound or a useful metal compound in which the metal is more electropositive than silver. Combinations of metal compounds and light can also be used.

Typical examples of fogging agents which are useful in the preparation of such emulsions include, for example, formadehyde, hydrazine, polyamines (e.g., triethylenetetramine, tetraethylenepentamine), thiourea dioxide, tetra(hydroxymethyl)phosphonium chloride, amineborane boron hydride compounds, stannous chloride and stannic chloride. Typical examples of useful metal compounds in which the metal is more electropositive than silver include soluble salts of gold, rhodium, platinum, palladium and iridium, for example, potassium chloroaurate, chloroauric acid, palladium ammonium chloride and sodium iridium chloride.

The fogging agent is generally used in an amount of from $1.0\times10^{-6}$ to $1.0\times10^{-1}$ mol per mol of silver halide.

Typical gold compounds include chloroauric acid, sodium chloroaurate, gold sulfide and gold selenide. In general these compounds are preferably included in amounts of from $1.0\times10^{-6}$ to $1.0\times10^{-4}$ mol per mol of silver halide.

The extent of the fogging of the pre-fogged direct positive type silver halide emulsions used in the present invention can vary over a wide range. The extent of the fogging is related to the silver halide composition and the grain size of the silver halide emulsion which is used, as is well known to those in the art, and also to the type and concentration of the fogging agent used, the pH and pAg values of the emulsions when fogging is carried out, the temperature and the time.

The direct positive type silver halides used in the present invention may contain, either individually or in combination, inorganic desensitizing agents (i.e., precious metal atoms, such as iridium or rhodium atoms) which are included within the silver halide grains and organic desensitizing agent which are adsorbed on the surface of the silver halide.

Examples of organic desensitizing agents which can be used in the invention include dimethinecyanine dyes which contain 2-(nitro-substituted-phenyl)indole nuclei, bis-(1-alkyl-2-phenyl)indol-3-trimethinecyanine dyes, aromaticsubstituted-indole nuclei containing cyanine dyes, imidazoquinoxaline dyes, asymmetric cyanine dyes which contain carbazole nuclei, trimethinecyanine dyes which contain 2-aromatic-substituted-indole nuclei, cyanine dyes which contain 2,3,3-trialkyl-3H-nitroindole nuclei, cyanine dyes which contain complex fused pyrimidinedione nuclei, quaternized merocyanine dyes which have 2-iso-oxazoline-5-one nuclei, 2-pyrazoline-5-one nuclei or complex fused pyrimidinedione nuclei, cyanine dyes which contain 2-allylimino-(or alkylimino)-4-allyl-(or alkyl)-3-thiazoline nuclei, merocyanine quaternary ammonium salt dyes which have 3-allylamino or 3-lower fatty acid amido substituted 2-pyrazoline-5-one nuclei, pyrylium, thiapyrylium and selenapyrylium salt dyes, cyanine dyes which have a nitrosubstituted-2-arylindole nucleus, (bipyridinium salt dyes, cyanine dyes which contain pyrrole nuclei which are bonded at the carbon atom in the 2-position, 1,2-diaryltrimethineindole dyes, cyanine dyes which contain 4-pyrazole nuclei, polymethine dyes which contain imidazole nuclei, dimethinecyanine dyes which contain a 2-phenyl substituted indole nucleus, trimethinecyanine dyes comprising two indole nuclei, cyanine dyes which contain 1-cyanoalkyl-2-arylindole nuclei, cyanine and merocyanine dyes in which the two nuclei have desensitizing substituent groups such as nitro groups, cyanine dyes which contain 1-alkyl-2-phenyl-substituted-indole nuclei, cyanine nuclei which contain 1-alkoxy-2-arylindole nuclei, cyanine dyes which have imidazo[4,5,6]quinoxaline nuclei, cycloheptanetriene ring containing dyes, indole nuclei containing dimethylcyanine dyes, dimethinecyanine dyes which contain [2,3-b]pyridine nuclei, cyanine dyes which contain pyrrole nuclei, dyes which contain pyrrolo[2,1-b]thiazole nuclei, cyanine dyes which contain indole or indolenine nuclei which contain benzoyl or phenylsulfonyl substituent groups, nitrostyryl compounds disclosed in U.S. Pat. No. 2,669,515, pinacryptol yellow and 5-m-nitrobenzylidenerhodanine, and the bispyridinium compounds disclosed in JP-B48-13059, dimethinecyanine dyes which contain pyrazolobenzimidazole nuclei, for example, 3-ethyl-2-[2-(1,2-dimethylbenzimidazo [2,1-e]-3-pyrazolin-3-yl)vinyl]benzothiazolium bromide, and dimethinecyanine dyes which have pyrazoloquinazolone nuclei, for example, 5-ethoxycarbonyl-1,3,3-trimathyl-2-[2-(2, 4-dimethyl-9-oxopyrazolo[5,1-b]quinazolin3-yl)vinyl]-3H-indolium-4-methylbenzenesulfonate, and 3-ethyl-2-[2-(2,4-dimethyl-9-oxopyrazolo[5,1-b]quinazolin-3yl)vinyl]benzothiazolium-4-methylbenzenesulfonate. (The term "JP-B" as used herein signifies an "examined Japanese patent publication".)

Furthermore, compounds (II-1), (II-2) and (II-3) which are represented by the following formula (II) are also useful.

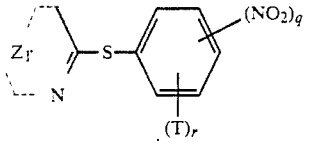

(II)

In this formula, $Z_1$ represents a group of nonmetal atoms which is required to form a nitrogen containing heterocyclic ring, T is an alkyl group, a cycloalkyl group, an alkenyl group, a halogen atom, a cyano group, a trifluoromethyl group, an alkoxy group, an aryloxy group, a hydroxyl group, an alkoxycarbonyl group, a carboxyl group, a carbamoyl group, a sulfamoyl group, an aryl group, an acylamino group, a sulfonamido group, a sulfo group or a benzo-condensed ring. These groups may have further substituent groups, q represents 1, 2 or 3, and r represents 0, 1 or 2.

Specific examples of the nitrogen containing heterocyclic rings which can be completed by $Z_1$ in formula (II) include 1,2,4-triazole, 1,3,4-oxadiazole, 1,3,4-thiadiazole, tetraazaindene, pentaazaindene, triazaindene, benzothiazole, benzimidazole, benzoxazole, pyrimidine, triazine, pyridine, quinoline, quinazoline, phthalazine, quinoxaline, imidazo[4,5-l]quinoxaline, tetrazole and 1,3-diazaprene rings. These rings may have further substituent groups and they may also be condensed with other rings.

Specific examples of compounds which can be represented by formula (II) are indicated below.

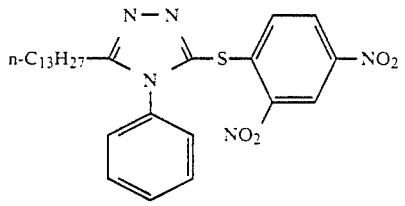

(II-1)

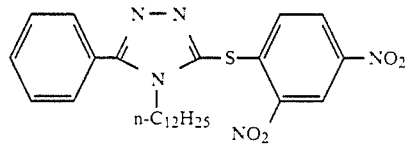

(II-2)

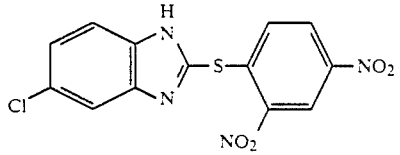

(II-3)

These compounds are preferably added in amounts of from $1\times10^{-6}$ to $5\times10^{-1}$ mol per mol of silver halide and, most desirably, they are added in amounts of from $1\times10^{-5}$ to $2\times10^{31\ 2}$ mol of silver halide.

When adding these compounds to a photographic photosensitive material, those which are soluble in water may be added to the silver halide emulsion solution or to a hydrophilic colloid solution in the form of an aqueous solution. Those which are water insoluble can be added in the form of a solution in an organic solvent which is miscible with water, such as an alcohol (for example, methanol or ethanol), an ester (for example, ethyl acetate) or a ketone (for example, acetone).

The addition of these compounds to the silver halide emulsion solution can be made at any time from the commencement of fogging and prior to the time of coating. But the addition is preferably made after completion of fogging, and they are preferably added to the coating liquid which is to be used for coating.

It is possible to provide the direct positive silver halide photographic photosensitive materials of the present invention with higher photographic speeds by including selenium compounds such as those disclosed in JP-A46-4282), and at least one dye selected from among the sensitizing dyes, for example dimethine trimethine cyanine dyes, halogen substituted hydroxyphthaleine dyes, phenazine dyes, cyanine dyes which contain benzothiazole or benzoselenazole nuclei, cyanine dyes which contain naphthoxazole nuclei, triphenylmethane dyes, cyanine dyes which contain indolenine nuclei, cyanine dyes which contain 2-pyridine rhodanine nuclei, cyanine dyes which contain thiazole nuclei, asymmetric cyanine, quinoline, meso-substituted cyanine dyes, cyanine dyes which contain rhodanine nuclei, and polymethine dyes which have three nuclei.

Various other common photographically useful additives can be included in the direct positive silver halide photographic photosensitive materials of the present invention. For example, triazoles, azaindenes, quaternary benzothiazolium compounds, mercapto compounds and water soluble inorganic salts of cadmium, cobalt, nickel, manganese, gold, thallium or zinc may be included as stabilizers. Aldehydes, such as, for example, formaldehyde, glyoxal or mucochloric acid, s-triazines, epoxides, aziridines and vinylsulfonic acids, may be included as film hardening agents. Saponin, poly(-sodium alkylenesulfonate), lauryl or oleyl mono-ethers of polyethyleneglycol, amylated alkyl taurine and fluorine containing compounds can be included as coating promotors. Moreover, color couplers can also be included. Finally, whiteners, ultraviolet absorbers, fungicides, matting agents and antistatic agents can also be included, as required.

Furthermore, so-called filter dyes which absorb and cut off visible light so that the materials can be handled with ultraviolet light sources under fluorescent lamps from which the ultraviolet light has been deleted, can be included in the direct positive silver halide photographic photosensitive materials of the present invention.

The dyes which can be used in the present invention absorb principally in the visible wave length region in the intrinsically sensitive wavelength region of the silver halide emulsions which are being used. Among them, the dyes which have a value of $\lambda_{max}$ of from 350 nm to 600 nm are preferred. No particular limitation is imposed on the chemical structure of the dyes, and use can be made, for example, of oxonol dyes, hemi-oxonol dyes, merocyanine dyes, cyanine dyes and azo dyes. But water soluble dyes are effective for ensuring that there is no remaining color after processing.

Specific examples of dyes which can be used include the pyrazolone dyes disclosed in JP-B-58-12576, the pyrazolone oxonol dyes disclosed in U.S. Pat. No. 2,274,782, the diarylazo dyes disclosed in U.S. Pat. No. 2,956,879, the styryl dyes and butadienyl dyes disclosed in U.S. Pat. Nos. 3,423,207 and 3,384,487, the merocyanine dyes disclosed in U.S. Pat. No. 2,527,583, the merocyanine dyes and oxonol dyes disclosed in U.S. Pat. Nos. 3,486,897, 3,652,284 and 3,718,472, the enamino hemi-oxonol dyes disclosed in U.S. Pat. No. 3,976,661, and the dyes disclosed in British Patents 584,609 and 1,177,429, JP-A-48-85130, JP-A-49-99620, JP-A-49-114420, and U.S. Pat. Nos. 2,533,472, 3,148,187, 3,177,078, 3,247,127, 3,540,887, 3,575,704 and 3,653,905.

A variety of surfactants can be included for various purposes in the photographic emulsion layers or other hydrophilic layers of photosensitive materials the direct positive emulsion of the present invention. They function, for example, as coating promotors or as antistatic agents, to improve slip properties, for emulsification and dispersion purposes, for the prevention of sticking and for improving photographic performance (for example, accelerating development, increasing contrast or increasing speed)

For example, use can be made of: nonionic surfactants, such as saponin (steroid based), alkylene oxide compounds (e.g., polyethylene glycol, polyethylene glycol/polypropylene glycol condensate, polyethylene glycol alkyl ethers or polyethylene glycol alkyl aryl ethers, polyethylene glycol esters, polyethylene glycol sorbitan esters, polyalkylene glycol alkyl amines or amides, and poly(ethylene oxide) adducts of silicones), glycidol compounds (e.g., alkenylsuccinic acid polyglyceride, alkylphenol polyglyceride), fatty acid esters of polyhydric alcohols and sugar alkyl esters; anionic surfactants which include acidic groups, such as carboxylic acid groups, sulfo groups, phospho groups, sulfate ester groups and phosphate ester groups, for example, alkylcarboxylates, alkylsulfonates alkylbenzenesulfonates, alkylnaphthalenesulfonates, alkylsulfate esters, alkylphosphate esters, N-acyl-N-alkyltaurines, sulfosuccinate esters, sulfoalkylpolyoxyethylene alkylphenyl ethers and polyoxyethylene alkylphosphate esters; amphoteric surfactants, such as amino acids, aminoalkylsulfonic acids, aminoalkyl sulfate or phosphate esters, alkylbetaines and amine oxides, and cationic surfactants, such as alkylamine salts, aliphatic or aromatic quaternary ammonium salts, heterocyclic quaternary ammonium salts, for example, pyridinium salts and imidazolium salts, and phosphonium salts and sulfonium salts which contain aliphatic or heterocyclic rings.

The poly(alkylene oxides) of a molecular weight of at least 600 disclosed in JP-B-58-9412 are especially desirable surfactants for use in the present invention.

The poly(alkylene oxides) which can be used in the present invention include condensates of poly(alkylene oxides) comprising at least 10 units of an alkylene oxide which has 2 to 4 carbon atoms (e.g., ethylene oxide, propylene-1,2-oxide, butene-1,2-oxide, and preferably ethylene oxide), with compounds which have at least one active hydrogen atom, for example, water, aliphatic alcohols, aromatic alcohols, fatty acids, organic amines and hexitol compounds, and block copolymers of two or more poly(alkylene oxides).

Before these poly(alkylene oxide) compounds are added to the silver halide emulsion, they can be dissolved in water at a suitable concentration, or in a low boiling point organic solvent which is miscible with water, and added at an appropriate time prior to coating. The addition is preferably made to the emulsion after chemical ripening. The addition can also be made, not to the emulsion, but to a nonphotosensitive hydrophilic colloid layer, for example, to an intermediate layer, a protective layer, or a filter layer.

Dispersions of water insoluble or sparingly soluble synthetic polymers can be included in the photographic emulsions of the present invention to improve their dimensional stability. For example, polymers or copolymers of alkyl (meth)acrylates, alkoxyalkyl (meth)acrylates, (meth)acrylamide, vinyl esters (e.g., vinyl acetate) and acrylonitrile can be used.

The emulsions used in the present invention in the main contain gelatin as the protective colloid, and the use of inert gelatin is especially convenient. Photographically inert gelatin derivatives (e.g., phthalated gelatin), water soluble polymers, for example poly(vinyl acrylate), poly(vinyl alcohol), polyvinylpyrrolidone, dextran and polyacrylamide, can be used instead of gelatin.

Polyols, such as trimethylolpropane, pentanediol, butanediol, ethylene glycol and glycerine, can be used as plasticizers.

The novel emulsions of the present invention can be used on any suitable photographically useful support, for example, a glass or film base such as cellulose acetate, cellulose acetate butyrate or polyester (e.g., poly- (ethylene terephthalate)). Blue colored supports are especially desirable.

The surface of the support is preferably subjected to a corona discharge treatment, a glow discharge treatment or an ultraviolet irradiation treatment to improve adhesion strength to the hydrophilic colloid layer. Alternatively, a subbing layer comprising a styrene/-butadiene based latex or a vinylidene chloride based latex may be provided, and a gelatin layer may be provided over this layer.

Furthermore, subbing layers formed using an organic solvent which contains a polyethylene swelling agent and gelatin may also be provided.

These subbing layers, can be applied together with surface treatment to improve further the strength of adhesion to the hydrophilic colloid layer.

Developing agents, for example hydroquinones, catechols, aminophenols, 3-pyrazolidones, ascorbic acid and derivatives thereof, reductones and phenylenediamines, or combinations of these developing agents, can be included in the silver halide photographic photosensitive emulsions of the present invention. The developing agents can be introduced into the silver halide emulsion layers and/or other photographic layers (e.g., protective layers, intermediate layers, filter layers, anti-halation layers and backing layers). The developing agents can be dissolved in a suitable solvent, or they can be added in the form of a dispersion as disclosed in U.S. Pat. No. 2,592,368 and French Patent 1,505,778.

Poly(methyl methacrylate) homopolymers, such as those disclosed in U.S. Pat. Nos. 2,992,101, 2,701,245, 4,142,894 and 4,396,706, polymers of methyl methacrylate and methacrylic acid, organic compounds such as starch, and inorganic compounds such as silica, titanium dioxide, and strontium and barium sulfates, for example, can be used as matting agents in the present invention. The particle size is from 1.0 to 10 μm, and preferably from 2 to 5 μm.

The silicone compounds disclosed, for example, in U.S. Pat. Nos. 3,489,576 and 4,047,958, the colloidal silica disclosed in JP-B-56-23139, paraffin wax, higher fatty acid esters and starch derivatives can be used as slip agents in the surface layer of a photographic photosensitive materials of the present invention.

All of the known methods can be used for photographic processing of photosensitive materials which have been made using the present invention. The known development baths can be used. The processing temperature is normally selected within the range from 10° C. to 50° C. Either development processing in which a silver image is formed (black and white photographic processing) or color development processing in which a dye image is formed can be used, depending on the purpose. More precisely, the materials can be developed and processed using the methods disclosed on pages 28–29 of *Research Disclosure* volume 176, No. 17643, and in the left hand column and the right hand column of page 651 of *Research Disclosure* volume 187, No. 18716.

The addition of organic substances to the emulsion layer and/or other hydrophilic colloid layers in such a way that they can be washed away during the development processing operations is preferred for the ultra-rapid processing of the present invention. In those cases where the substance which is washed away is gelatin, the gelatins which do not undergo crosslinking reactions with film hardening agents are preferred. For example, acetylated gelatin or phthalated gelatin can be used for this purpose, and those which have a low molecular weight are preferred. On the other hand, polyacrylamide disclosed in U.S. Pat. No. 3,271,158, or hydrophilic polymers such as poly(vinyl alcohol) and polyvinylpyrrolidone, can be used as macromolecular substances other than gelatin. Dextran and sugars such as saccharose and pluran for example are also effective. Among these materials, polyacrylamide and dextran are preferred, and polyacrylamide is the most desirable substance. The average molecular weight of these substances is preferably up to 20,000, and most desirably up to 10,000.

Combinations of dihydroxybenzenes and 1-phenyl-3-pyrazolidones are preferred as the developing agent in the black and white development baths which are used for development processing of the direct positive silver halide emulsion of the present invention since they facilitate good performance. Of course, p-aminophenol based developing agents can also be included.

Dihydroxybenzene developing agents which can be used in the invention include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone and 2,5-dimethylhydroquinone, with hydroquinone being especially desirable.

The p-aminophenol based developing agents which are used in the invention include N-methyl-p-aminophenol, p-aminophenol, N-(β-hydroxyethyl)-p-aminophenol, N-(4-hydroxyphenyl)glycine, 2-methyl-p-aminophenol and p-benzylaminophenol. Of these, N-methyl-p-aminophenol is preferred.

The 3-pyrazolidone based developing agents which are used in the present invention include, for example, 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3pyrazolidone, 1-p-aminophenyl-4,4-dimethyl-3-pyrazolidone, 1-p-tolyl-4,4-dimethyl-3-p-yrazolidone and 1-p-tolyl-4-methyl-4-hydroxymethyl-3-pyrazolidone.

Normally, the developing agent is preferably used at a concentration of from 0.01 mol/liter to 1.2 mol/liter.

Sodium sulfite, potassium sulfite, lithium sulfite, ammonium sulfite, sodium bisulfite or potassium metabisulfite, for example, can be used for the sulfite preservative which is used in development processing in the present invention. A sulfite concentration of at least 0.2 mol/-liter, and preferably of at least 0.4 mol/liter is desirable. An upper limit of 2.5 mol/liter is preferred.

The pH of the developer used for development processing in the present invention is from 9 to 13. Preferably the developer pH is 10 and 12.

Agents for adjusting pH, such as sodium hydroxide, potassium hydroxide, sodium carbonate, potassium carbonate, sodium triphosphate and potassium triphosphate, can be included as alkalis to set the pH.

Buffers, such as those disclosed in JP-A-62-186259 (borates), those disclosed in JP-A-60-93433 (e.g., saccharose, acetoxime and 5-sulfosalicylic acid), phosphates and carbonates, can be used.

Dialdehyde based film hardening agents or bisulfite adducts thereof can also be used in the above mentioned developers. In practice, glutaraldehyde and its bisulfite adduct, for example, are used.

Additives other than the components mentioned above which can be used include development inhibitors (such as, sodium bromide, potassium bromide and potassium iodide), organic solvents (such as, ethylene glycol, diethylene glycol, triethylene glycol, dimethyformamide, methylcellosolve, hexylene glycol, ethanol and methanol), antifoggants (such as, mercapto compounds, such as, 1-phenyl-5-mercaptotetrazole and 2-mercaptobenzimidazole-5-sulfonic acid, sodium salt; indazole based compounds, such as, 5-nitroindazole, and benztriazole based compounds, such as, 5-methylbenztriazole), toners, surfactants, anti-foaming agents, hard water softening agents, and the amino compounds disclosed in JP-A-56-106244, for example, may be included, as required.

Silver contamination inhibitors, for example, the compounds disclosed in JP-A-56-24347, can be used in the development processing in the present invention.

Amino compounds, such as the alkanolamines disclosed in JP-A-56-106244, can be used in the developers of the present invention.

A fixing bath is an aqueous solution containing thiosulfate. Its pH is at least 3.8, preferably from 4.2 to 7.0, and most desirably from 4.5 to 5.5.

Sodium thiosulfate or ammonium thiosulfate, for example, is used for the fixing agent, but ammonium thiosulfate is preferred from the point of view of the fixing rate. The amount of fixing agent used can be varied appropriately, and it is generally used at concentrations of from about 0.1 mol/liter to about 6 mol/liter.

The water soluble aluminum salts which are used as film hardening agents may be included in the fixing bath, and these include, for example, aluminum chloride, aluminum sulfate and potassium alum.

Tartaric acid, citric acid, gluconic acid, or derivatives of these acids can be used individually, or conjointly in combinations of two or more, in the fixing bath. These compounds are effective when included at concentrations of at least 0.005 mol per liter of fixing bath, and they are especially effective when used at concentrations of from 0.01 to 0.03 mol/liter.

Preservatives (e.g., sulfites, bisulfites), pH buffers (e.g., acetic acid, boric acid), pH adjusting agents (e.g., sulfuric acid), chelating agents capable of softening hard water and the compounds disclosed in JP-A-62-78551 can be included as required in the fixing bath.

It is preferred that the swelling factor (percentage) of the photosensitive material be made small (preferably 100% - 200%) for the ultra-rapid processing of the present invention so that the amount of process film hardening is preferably small. That is to say, film hardening effects are not likely to arise during development, nor are they likely to arise during fixing. This is because of the small degree of swelling of the photosensitive material.

The film hardening reaction is weak in fixing baths of pH of at least 4.6, and fixing baths in which there are no film hardening agents at all are preferred. The development processing procedure of the silver halide photographic photosensitive materials of the present invention described above includes washing (or stabilizing) and drying the said photosensitive materials after the development and fixing processes. When the silver halide photosensitive materials of this present invention are processed in an automatic processor which includes at least the above mentioned processes of development, fixing, washing (or stabilization) and drying, conventional RP processing from development to drying is completed within 90 seconds, and the ultra-rapid processing from development to drying is completed within 60 seconds. In other words, the time from the moment the leading edge of the photosensitive material is immersed in the developer to the time at which the same edge of the material which has been passed through the fixing, washing and drying stages emerges from the drying zone (the so-called dry to dry time) is within 60 seconds.

The invention is described below by means of an illustrative example, but the embodiments of the invention are not limited to this example.

EXAMPLE

The emulsions of this Example were prepared and tested in the following ten steps.

1. Preparation of a Silver Halide Emulsion of The Present Invention

Appropriate quantities of thioether (A) having a structural formula $HOCH_2CH_2SCH_2CH_2SCH_2CH_2OH$ or ammonia (B) were added, as solvents, to a reactor which contained gelatin and potassium bromide and which had been heated to 55° C. After this addition, an aqueous solution of silver nitrate and an aqueous solution of potassium bromide were added using the controlled double jet method, maintaining a pAg value within the reactor of 7.6, and grains were formed. The quantities of thioether and ammonia were adjusted to obtain the average grain size of 0.42 μ. These grains were cubic grains and they formed a monodispersion in which 98% of all the grains were of a size within ±40% of the average grain size.

The emulsions so obtained were subjected to a desalting treatment and then dispersing gelatin and 30,000 ppm of phenoxyethanol with respect to this gelatin were added. The pH was set to 6.8, the pAg was set to 8.9, and then the emulsion was fogged with thiourea dioxide and chloroauric acid by heating to 65° C. for 50 to 110 minutes. The amount of chloroauric acid was the same in each emulsion at 3 mg/mol·Ag. By changing the amount of thiourea dioxide and the fogging time, the photographic speeds were compared at the smallest amount of thiourea dioxide and the shortest fogging time for providing the maximum density $D_{max}$ with standard processing of RP (Rapid Processing) 90 seconds and SP (Superrapid Processing) 45 seconds. This was because those emulsions in which the extent of the fogging of the pre-fogged direct positive emulsion was low and which did not provide $D_{max}$ were seen to have an apparently high speed, and because it was necessary to provide the standards indicated above to make a speed comparison between the emulsions.

Emulsion 1: The grains were formed using the thioether (A) as the solvent, and fogging was carried out with 6.4 mg/mol·Ag of thiourea dioxide and 3 mg/mol·Ag of chloroauric acid for 50 minutes.

Emulsions 2–5: The thioether (A) was used as the solvent, and 0.5, 3, 20 and 25 g/mol·Ag of Compound (I-12) of the present invention was added to the reactor, respectively. The grains were formed and the fogged Emulsions 2–5 were then prepared by fogging the grains with 6.4 mg/mol·Ag of thiourea dioxide and 3 mg/mol·Ag of chloroauric acid for 60, 80, 100, and 110 minutes, respectively.

Emulsion 6: The thioether (A) was used as the solvent, 3 g/mol·Ag of Compound (I-2) of the present invention was added to the reactor and grains were formed. Fogging was carried out with 6.4 mg/mol·Ag of thiourea dioxide and 3 mg of chloroauric acid for 90 minutes.

Emulsion 7: The thioether (A) was used as the solvent, 3 g/mol·Ag of Compound (I-7) of the present invention was added to the reactor and grains were formed. Fogging was carried out with 6.4 mg/mol·Ag of thiourea dioxide and 3 mg/mol·Ag of chloroauric acid for 75 minutes.

Emulsion 8: The thioether (A) was used as the solvent, 3 g/mol·Ag of Compound (I-21) of the present invention was added to the reactor and grains were formed. Fogging was carried out with 6.4 mg/mol·Ag of thiourea dioxide and 3 mg/mol·Ag of chloroauric acid for 70 minutes.

Emulsion 9: The thioether (A) was used as the solvent, 3 g/mol·Ag of Compound (I-24) of the present invention was added to the reactor and grains were formed. Fogging was carried out with 6.4 mg/mol·Ag of thiourea dioxide and 3 mg/mol·Ag of chloroauric acid for 65 minutes.

Emulsion 10: Ammonia was used as the solvent, grains were formed. Fogging was carried out with 6.4 mg/mol·Ag of thiourea dioxide and 3 mg/mol·Ag of chloroauric acid for 50 minutes.

Emulsions 11–13: Ammonia was used as the solvent, Compound (I-12) of the present invention was added in amounts of 3, 20 and 25 mg/mol·Ag, respectively, and grains were formed. Fogging was carried out with 9.6, 13 and 13 mg/mol·Ag of thiourea dioxide and 3 mg/mol·Ag of chloroauric acid for 50 minutes in each case.

Emulsion 14: The thioether (A) was used as the solvent and, after grain formation, KI (1%) was added to form AgBrI which contained 0.26 mol% iodine. Fogging was carried out using 6.4 mg/mol·Ag of thiourea dioxide and 3 mg/mol·Ag of chloroauric acid for 80 minutes.

Emulsion 15: Compound (I-12) (3 grams/mol·Ag) of the present invention was added to the same material as Emulsion 14.

2. Preparation of the Emulsion Coating Liquids

Emulsions 1–15 were measured out separately in 1000 gram lots into containers and heated to 40° C. to form a solution. Then, 50 cc of a 0.8% methanol solution of the sensitizing agent, 5-ethoxycarbonyl-1,3,3-trimethyl-2-[2(2,4-dimethyl-9-oxopyrazolo [5,1-b]quinazolin-3-yl)vinyl]-3H-indolinium-4-methylbenzenesulfonate, 50 cc of a 0.5% methanol solution of compound (II-2), 20 cc of a 5% aqueous solution of wetting agent trimethylolpropane, an aqueous solution of stabilizer, 4-hydroxy-6-methyl-1,3,3a-7-tetra-azaindene, an aqueous solution of coating aid, dodecylbenzenesulfonic acid salt, an aqueous solution of binder aid, polyacrylamide, and an aqueous solution of viscosity increasing agent, poly(-potassium p-vinylbenzenesulfonate) compound, were added to provide the respective coating liquids.

The coating liquids obtained from Emulsions 1–15 were labelled (i)–(xv), respectively.

3. Preparation of the Coating Liquid For the Surface Protecting Layer of the Photosensitive Material Layer An aqueous solution of the viscosity increasing poly(-sodium styrenesulfonate), a matting agent comprising fine poly(methyl methacrylate) particles of two different particle sizes (average particle sizes 3 μm and 0.8 μm), the film hardening agent N,N'-ethylenebis(vinylsulfonylacetamide), an aqueous solution of the coating aid, sodium t-octylphenoxyethoxyethanesulfonic acid, an aqueous solution of polyethylene based surfactants (whose structures are indicated below), an aqueous solution of a fluorine containing surfactant (structure is indicated below) as an antistatic agent, an aqueous solution of polyacrylamide and polyacrylic acid, silica, and 500 ppm of "Proxel" with respect to the gelatin were added to a 10 wt.% aqueous solution of gelatin which had been heated to 40° C. to form a coating liquid. The film hardening agent was set to 1.5 wt° % with respect to the total gelatin in the protective layer and the emulsion and adjusted so that the water swelling measured at 20° C. was 150%.

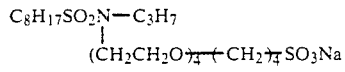

$C_{16}H_{33}O(CH_2CH_2O)_{10}H$

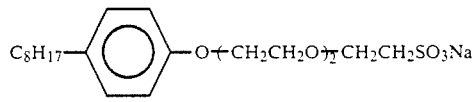

$C_8F_{17}SO_3K$

4. Preparation of the Backing Layer Coating Liquid

An aqueous solution of the viscosity increasing poly(-sodium ethylenesulfonate), 400 cc of a 6% aqueous solution of each of the three dyes shown below, an aqueous solution of the film hardening agent, N,N'-ethylenebis(vinylsulfonylacetamide), an aqueous solution of the coating aid, sodium tert-octylphenoxyethoxyethanesulfonate, fine particles of poly(methyl methacrylate) (average particle size 1.2 μm), silica, an aqueous solution of a copolymer of methyl methacrylate and ethyl acrylate, and 500 ppm of "Proxel" with respect to the gelatin were added to 1000 grams of a 10 wt.% aqueous solution of gelatin which had been heated to 40° C. and a coating liquid was obtained.

Dyes

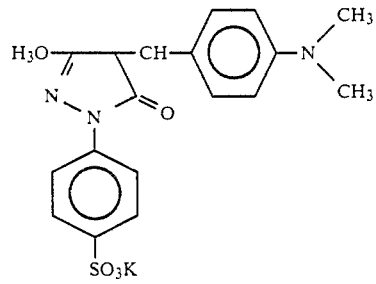

(1)

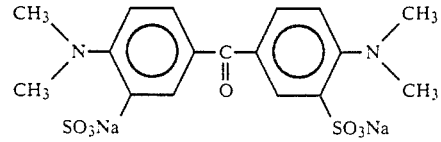

(2)

-continued

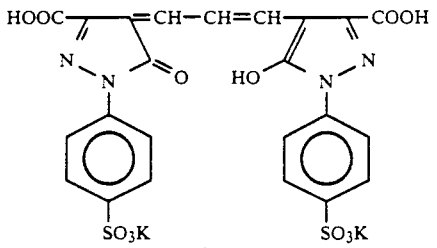

(3)

5. Preparation of the Coating Liquid for the Surface Protecting Layer of the Backing Layer An aqueous solution of the viscosity increasing poly(sodium styrenesulfonate), a matting agent consisting of fine particles of poly(methyl methacrylate) (average particle size 3.0 μm), an aqueous solution of the coating acid, sodium tert-octylphenoxyethoxyethanesulfonate and an aqueous solution of the polyethylene based surfactants (having the five structures indicated below), an aqueous solution of a fluorine containing compound as an antistatic agent, and 500 ppm of "Proxel" with respect to the gelatin, were added to a 10 wt% aqueous gelatin solution which had been heated to 40° C. and a coating liquid was obtained.

Surfactants $Ch_{16}H_{33}O(CH_2CH_2O)_{10}H$ (1)

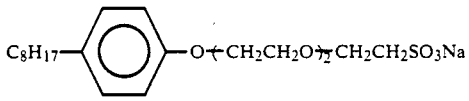

(2)

$C_8F_{17}SO_2N(C_3H_7)—(CH_2CH_2O)_4—(CH_2)_4SO_3Na$ (3)

$C_8F_{17}SO_2N(C_3H_7)CH_2COOK$ (4)

and $C_8F_{17}SO_2N(C_3H_7)(CH_2CH_2O)_{15}—H$ (5)

6. Preparation of Coated Samples

The backing layer coating liquid described above was coated together with the backing surface protective layer coating liquid onto one side of a poly(ethylene) terephthalate) support to provide a total coated weight of gelatin of 3.2 g/m², made up of 0.7 g/m² in the backing layer and 2.5 g/m² in the backing protective layer.

Next, the emulsion coating liquids described in Step 2 and the protective layer coating liquid described in Step 3 were coated sequentially from the support side onto the other side of the support. The coated gelatin weight of the protective layer was 1.4 g/m² in each case.

The coated silver weight with emulsion coating liquids (i)-(xv) was 2.6 g/m² in each case, and the coated samples so obtained were designated Samples (I)-(XV).

7. Development Processing

Six coated samples of each type were subjected for 7 days to a temperature of 20° C., 65% TH, after which they were subjected to a 5 second sensitometric exposure with a BLB light source at room temperature using a duplicator made by Dupont Co. After exposure, the samples were processed at 35° C. with a conventional 90-second RP process using an FPM-4000 automatic processor made by Fuji Photographic Film Co., Ltd. with developer RD-3 and Fuji F fixer. Furthermore, ultra-rapid processing was also carried out at 35° C. in an FPM-9000 automatic processor made by Fuji Photographic Film Co., Ltd. in a dry to dry time of 45 seconds using developer RD-7 and Fuji F fixer.

8. Assessment of Photographic Properties

The relative speeds at D=1 were taken for the speed from the sensitometry described in Step 7, and the relative speeds obtained on taking the speed of sample 1 processed in the FPM-4000 using RP-90 seconds are shown in Table 1.

9. Evaluation of the Sensibility of the Film to Damage in Automatic Processor Processing The emulsion surface of the processed and dried films were inspected visually for pin-hole like damage and where such damage had occurred that result is indicated by x, and where no such damage had occurred and the sample was normal that result is indicated by o.

10. Summary of Results

The results are summarized in Table 1.

Only the combinations of the present invention provided a high photographic speed and no damage to the emulsion surface due to automatic processing.

Furthermore, the same results were obtained using the normal RP 90-second process and the superrapid SP 45-second process.

TABLE 1

| | Grain Formation | | | | Fogging Agents And Time | | |
|---|---|---|---|---|---|---|---|
| Samples | Solvent | AgX Comp. | $RSO_2M$ | g/mol · Ag | Thio-urea Di-oxide g/mol · Ag | Chloro-auric Acid g/mol · Ag | Min. |
| 1 | A | AgBr | — | — | 6.4 | 3 | 50 |
| 2 | A | AgBr | I-12 | 0.5 | 6.4 | 3 | 60 |
| 3 | A | AgBr | I-12 | 3 | 6.4 | 3 | 80 |
| 4 | A | AgBr | I-12 | 20 | 6.4 | 3 | 100 |
| 5 | A | AgBr | I-12 | 25 | 6.4 | 3 | 110 |
| 6 | A | AgBr | I-2 | 3 | 6.4 | 3 | 90 |
| 7 | A | AgBr | I-7 | 3 | 6.4 | 3 | 75 |
| 8 | A | AgBr | I-21 | 3 | 6.4 | 3 | 70 |
| 9 | A | AgBr | I-24 | 3 | 6.4 | 3 | 65 |
| 10 | B | AgBr | — | — | 6.4 | 3 | 50' |
| 11 | B | AgBr | I-12 | 3 | 9.6 | 3 | 50' |
| 12 | B | AgBr | I-12 | 20 | 13 | 3 | 50' |
| 13 | B | AgBr | I-12 | 25 | 13 | 3 | 50' |
| 14 | A | AgBrI | — | — | 6.4 | 3 | 80 |

TABLE 1-continued

| 15 | A | AgBrI | I-12 | 3 | 6.4 | 3 | 80 |
|---|---|---|---|---|---|---|---|
| | RP90-Second (FPM-4000, 35°) | | | SP45-Seconds (FPM-9000 35°) | | | |
| Samples | Speed | Sensibility of the Emulsion Surface to Damage in Processing | | Speed | Sensibility of the Emulsion Surface to Damage in Processing | | |
| 1 | 100 | O | | 90 | O | Comp. Ex. | |
| 2 | 120 | O | | 115 | O | Invention | |
| 3 | 140 | O | | 134 | O | Invention | |
| 4 | 140 | O | | 135 | O | Invention | |
| 5 | 140 | x | | 131 | x | Comp. Ex. | |
| 6 | 125 | O | | 120 | O | Invention | |
| 7 | 120 | O | | 120 | O | Invention | |
| 8 | 130 | O | | 125 | O | Invention | |
| 9 | 125 | O | | 120 | O | Invention | |
| 10 | 85 | O | | 80 | O | Comp. Ex. | |
| 11 | 110 | O | | 100 | O | Invention | |
| 12 | 115 | O | | 100 | O | Invention | |
| 13 | 110 | x | | 100 | x | Comp. Ex. | |
| 14 | 105 | O | | 100 | O | Comp. Ex. | |
| 15 | 125 | O | | 120 | O | Invention | |

A: $HOCH_2CH_2SCH_2CH_2SCH_2CH_2OH$
B: $NH_3$

While the invention has been described in detail and with reference to specific embodiments thereof, it will be apparent to one skilled in the art that various changes and modifications can be made therein without departing from the spirit and scope thereof.

What is claimed is:

1. A pre-fogged direct positive silver halide emulsion comprising silver halide grains which have been formed in the presence of a compound represented by the following formula (I):

$$R—SO_2—M \quad (I)$$

wherein R represents an aliphatic group, an aromatic group or a heterocyclic group, and M represents a hydrogen atom or a cation.

2. The pre-fogged direct positive silver halide emulsion of claim 1, wherein the aliphatic group represented by R in formula (I) is a straightchain, branched or cyclic alkyl or alkenyl or alkenyl or alkynyl group having from 1 to 30 carbon atoms.

3. The pre-fogged direct positive silver halide emulsion of claim 1, wherein the aromatic group represented by R in formula (I) is a monocyclic, bicyclic or tricyclic aryl group having from 6 to 18 carbon atoms.

4. The pre-fogged direct positive silver halide emulsion of claim 1, wherein the heterocyclic group represented by R in formula (I) is one of from three- to ten-membered saturated or unsaturated heterocyclic groups containing at least one atom selected from the N, O and S atom.

5. The pre-fogged direct positive silver halide emulsion of claim 1, wherein the amount of the compound represented by formula (I) added to the silver halide grains during grain formation is 0.1 to 23 grams per mol of silver halide in the grains.

6. The pre-fogged direct positive silver halide emulsion of claim 1, wherein the silver halide emulsion is monodisperse and at least 50% of the silver halide grains have a (100) plane/(111) plane ratio of at least 1.

7. The pre-fogged direct positive silver halide emulsion of claim 1, wherein the silver halide grains have a (100) plane/((111) plane of ratio of at least 1.

8. A method for a pre-fogged direct positive silver halide emulsion comprised of silver halide grains, comprising the step of, forming the silver halide grains, and adding a compound represented by the following formula (I) to the silver halide grains during the formation of the silver halide grains or adding said compound of formula (I) to a reaction medium in which the grains are to be formed prior to the beginning of grain formation:

$$R—SO_2—M \quad (I)$$

9. The method of claim 8, wherein a silver halide solvent selected from ammonia, potassium thiocyanate ammonium thiocyanate, a thioether compound, a thione compound and an amine compound is present during the formation of the silver halide grains.

10. The method of claim 8, wherein the amount of the compound represented by formula (I) added to the silver halide grains during grain formation is 0.1 to 23 grams per mol of silver in the grains.

11. The method of claim 8, wherein the silver halide emulsion is monodisperse and at least 50% of the silver halide grains have (100) plane/(111) plane ratio of at least 1.

12. The method of claim 8, wherein the silver halide emulsion is monodisperse and at least 80% of the silver halide grains have a (100) plane/(111) plane ratio of at least 1.

13. The fogged direct positive silver halide emulsion of claim 1, wherein the formation of the grains, during which said compound of formula (I) is present, comprises nuclei formation and grain growth.

14. The fogged direct positive silver halide emulsion of claim 13, wherein said compound of formula (I) is added to the silver halide grains during the formation of the grains.

15. The fogged direct positive silver halide emulsion of claim 13, wherein said compound of formula (I) is added to a reaction medium in which the grains are to be formed prior to the beginning of grain formation.

16. The method of claim 8, wherein said step of forming the silver halide grains comprises nuclei formation and grain growth.

17. The method of claim 16, wherein said compound of formula (I) is added to the silver halide grains during formation of the grains.

18. The method of claim 16, wherein said compound of formula (I) is added to a reaction medium in which the grains are to be formed prior to the beginning of grain formation.

* * * * *